US005708448A

United States Patent [19]

Wallace

[11] Patent Number: 5,708,448

[45] Date of Patent: Jan. 13, 1998

[54] DOUBLE HELIX ANTENNA SYSTEM

[75] Inventor: Ray C. Wallace, San Diego, Calif.

[73] Assignee: Qualcomm Incorporated, San Diego, Calif.

[21] Appl. No.: 490,925

[22] Filed: Jun. 16, 1995

[51] Int. Cl.[6] ..... H01Q 1/36

[52] U.S. Cl. ..... 343/895

[58] Field of Search ..... 343/895; H01Q 1/36, H01Q11/08

[56] References Cited

U.S. PATENT DOCUMENTS

| | | | |
|---|---|---|---|
| 3,111,669 | 11/1963 | Walsh | 343/895 |
| 3,940,772 | 2/1976 | Ben-dov | 343/895 |
| 4,011,567 | 3/1977 | Ben-Dov | 343/895 |
| 5,191,352 | 3/1993 | Branson | 343/895 |
| 5,255,005 | 10/1993 | Ternet et al. | 343/895 |
| 5,346,300 | 9/1994 | Yamamoto et al. | 343/895 |
| 5,349,365 | 9/1994 | Ow et al. | 343/895 |

FOREIGN PATENT DOCUMENTS

| | | | |
|---|---|---|---|
| 0635898 | 1/1995 | European Pat. Off. | H01Q 1/27 |
| 0657956 | 6/1995 | European Pat. Off. | H01Q 11/08 |
| 2727900 | 6/1977 | Germany | H01Q 1/36 |
| 2271670 | 4/1994 | United Kingdom | H01Q 21/30 |

*Primary Examiner*—Donald T. Hajec
*Assistant Examiner*—Tho Phan
*Attorney, Agent, or Firm*—Russell B. Miller; Roger W. Martin

[57] ABSTRACT

A double helix antenna comprised of orthogonally-wound helix conductors is disclosed. The double helix antenna system includes a first helix conductor wound in a first direction about a vertical axis of the double helix antenna. A second helix conductor is wound in a second direction about the longitudinal axis. In a specific implementation, the first and second helix conductors are of different lengths, respectively corresponding to first and second frequency bands. Additionally, the first and second helix conductors are wound so as to be orthogonal at those horizontal planes within which the first and second helix conductors intersect or are otherwise minimally separated in the horizontal dimension. This orthogonal winding relationship between the helix conductors substantially reduces mutual coupling, thus enabling operation of separate helical antennas in close physical proximity. In a particular application, the double helix antenna system is incorporated within a portable communications device.

17 Claims, 4 Drawing Sheets

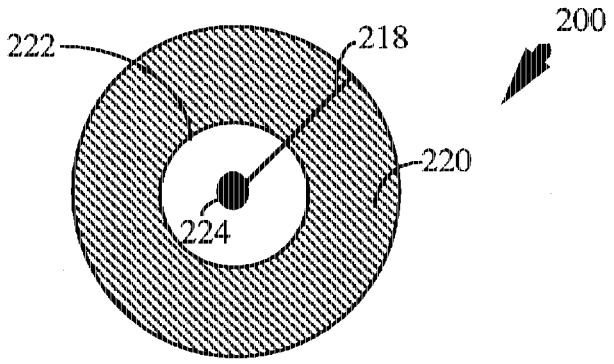
FIG. 6B
FIG. 6A
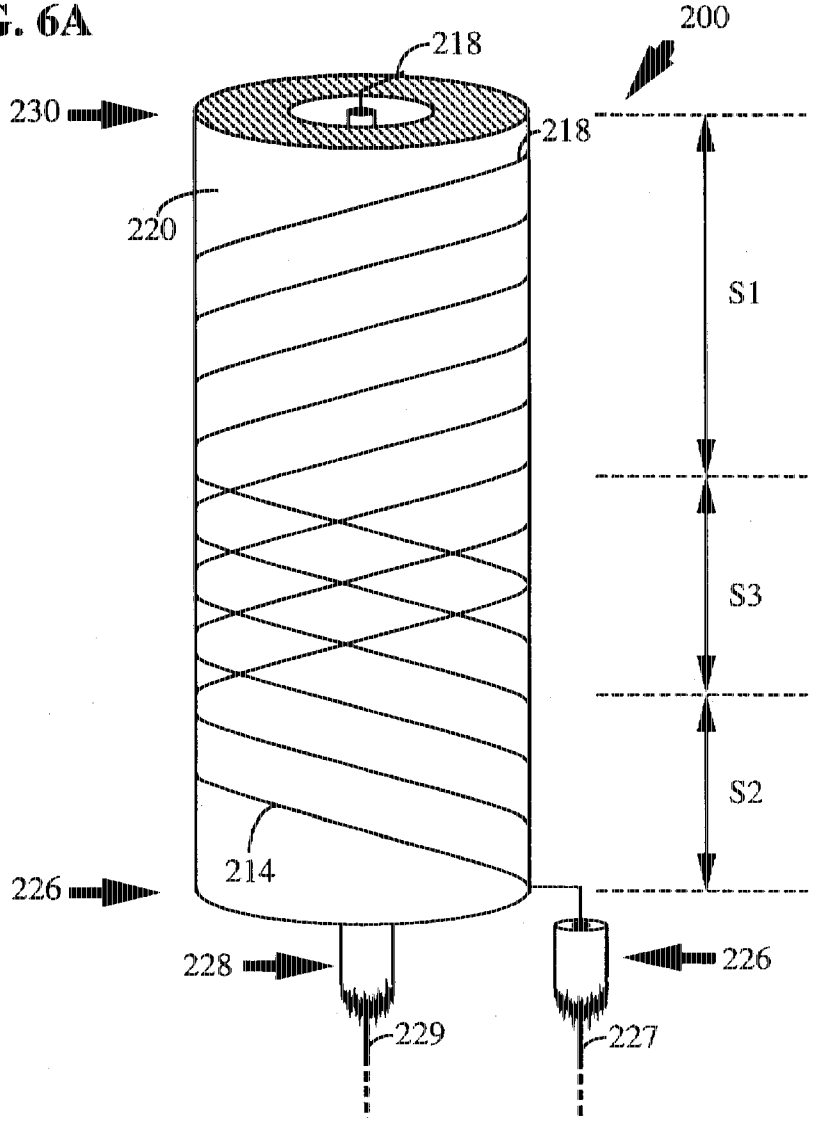

DOUBLE HELIX ANTENNA SYSTEM

BACKGROUND OF THE INVENTION

I. Field of the Invention

The present invention relates to helical antennas, and in particular to a double helix antenna for use within a mobile communications system.

II. Description of the Related Art

Within existing portable telephones, both the transmitter and the receiver are usually active at the same time, and one antenna is shared for transmission and reception. This simultaneous use of the antenna is achieved by means of a filtering system known as a duplexer. A duplexer is used to ensure that proper filtering is provided between the transmitter and the antenna, as well as between the receiver and the antenna. It also provides isolation between the transmitter and the receiver, so that the transmitter does not desensitize the receiver. In order for the duplexer to provide good filtering characteristics, it typically requires a resonant circuit consisting of many LC (inductor/capacitor) filter sections. The proper tuning of this complex circuitry is crucial to obtaining adequate isolation within the portable telephone, and generally must be performed by skilled personnel.

The requirement for a duplexer stems from the sharing of a single antenna for both transmission and reception. One possible way of obviating the need for a duplexer would be to equip the portable telephone with separate transmit and receive antennas. Unfortunately, the mutual coupling arising between such a separate pair of antennas would tend to adversely affect each projected antenna pattern. In addition, the inclusion of separate antennas tends to increase the cost, size and complexity of the portable phone, particularly if additional space must be allocated for retraction of each antenna. An antenna arrangement including separate antenna elements capable of operating in close proximity with minimal mutual coupling would thus be a significant advance in the state of the art.

In the so-called "dual-band" portable phones currently being developed for operation over the cellular band (824 MHz to 892 MHz) and the proposed Personal Communication Network (PCN) band (1.8 GHz to 1.96 GHz), the antenna duplexing circuitry is required to be even more complex. This complexity arises from the additional filtering required to provide isolation between the separate transceivers dedicated to communication over each frequency range. Accordingly, the duplexing circuitry must provide adequate isolation not only between the different operating bands, but also between the transmit and receive channels of each band. If the duplexing circuitry were implemented so as to include a separate transmit/receive duplexer within each transceiver, an RF switch would need to be provided for alternately connecting the separate duplexers to the antenna. As is well known, RF switches tend to be expensive, and render the devices in which they are incorporated subject to single-point failure.

Interest in alternative designs for portable phone antennas has also increased recently due to concern over the effects of electromagnetic fields upon human operators. Although antenna designs have been proposed in which the bulk of the antenna radiation is directed away from the operator, the performance of such "directional" designs becomes significantly compromised when operator movement results in antenna orientations away from the strongest signal source.

SUMMARY OF THE INVENTION

In summary, these and other objects are met by a double helix antenna system of the present invention. The double helix antenna system includes a first helix conductor wound in a first direction about a vertical axis of the double helix antenna. A second helix conductor is wound in a second direction about the longitudinal axis. In a specific embodiment the first and second helix conductors are of different lengths, respectively corresponding to first and second frequency bands. In addition, the first and second helix conductors are wound so as to be orthogonal at those horizontal planes within which the first and second helix conductors intersect or are otherwise minimally separated in the horizontal dimension. This orthogonal winding relationship between the helical conductors minimizes mutual coupling, thus enabling operation of separate helical antennas in close physical proximity.

In an exemplary implementation, the double helix antenna system is adapted for operation in a portable communications device. This is achieved by connecting the first helix conductor to a transmitter of the communications device through a first antenna feed line. A second antenna feed line is also provided for connecting the second helix conductor to a receiver of the communications device. Again, the orthogonal winding relationship between the first and second helix conductors results in minimal mutual coupling, thereby enabling improved isolation to exist between the transmitter and receiver.

BRIEF DESCRIPTION OF THE DRAWINGS

Additional objects and features of the invention will be more readily apparent from the following detailed description and appended claims when taken in conjunction with the drawings, in which:

FIGS. 6A and 6B respectively provide perspective and top views of an alternate embodiment of a double helix antenna designed to reduce operator exposure to electromagnetic field energy.

DESCRIPTION OF THE PREFERRED EMBODIMENT

Figure 1:
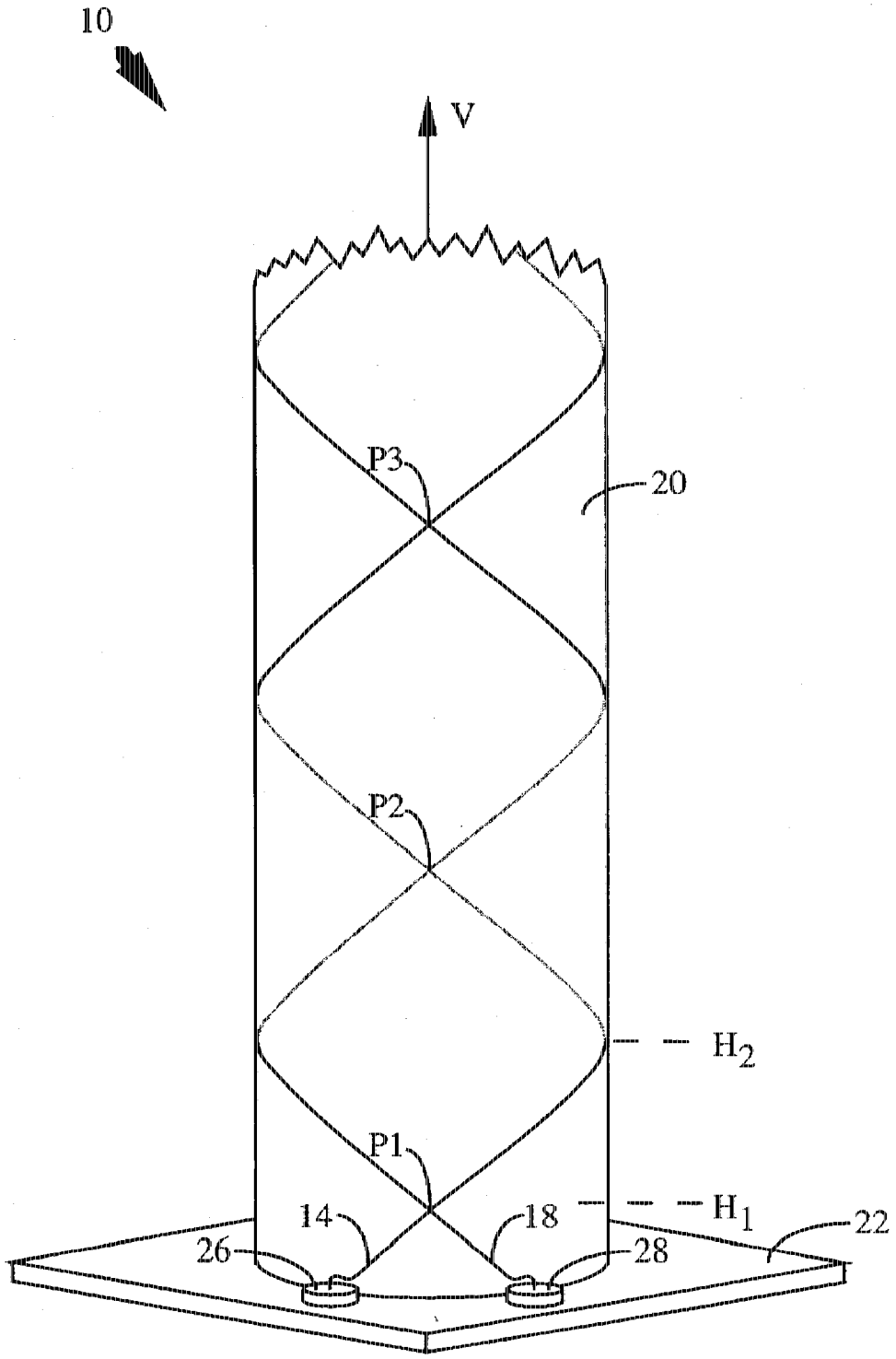
FIG. 1 shows an exemplary embodiment of a double helix antenna of the present invention.

FIG. 1 shows an exemplary embodiment of a double helix antenna 10 of the present invention. In FIG. 1, the double helix antenna 10 includes a first helix conductor 14 and a second helix conductor 18. The first and second helix conductors 14 and 18 are seen to be wound in opposite directions about a cylindrical winding member 20, which is anchored by ground plane 22. The helix conductors 14 and 18 function independently as separate antennas, and in the embodiment of FIG. 1 are respectively coupled to coaxial feed lines 26 and 28. The center conductors of the feed lines 26 and 28 are electrically connected to the conductors 14 and 18, respectively, while the outer conductor of each feed line 26 and 28 contacts the ground plane 22.

The winding member 20 may be realized from either an insulating dielectric material, or from a conductive material.

However, it has been found that improved isolation is obtained between the separate antennas comprised of helix conductors 14 and 18 when the winding member is fabricated from a conductive material, such as copper.

The helix conductors 14 and 18 are of the same pitch, and are wound about member 20 so as to be orthogonal at each point of intersection. This winding technique has been found to result in minimal energy coupling between the conductors 14 and 18, even when these independently operating antennas are wound about the same vertical axis V. The conductors 14 and 18 are seen to be orthogonal at each of three intersection points P1, P2 and P3. For completeness, the segments of the conductors 14 and 18 wound on the "rear" surface of the winding member 20 which, due to the frame of reference of FIG. 1 are hidden from view, are depicted using dashed lines. Accordingly, intersection point P2 is located on the rear surface of winding member 20, and intersection points P1 and P3 are located on the winding member surface within view in FIG. 1.

It is known that the nominal center frequency of a helical antenna of a given pitch is dependent upon its length. Accordingly, one way of configuring the antenna 10 for dual-band operation is to use helix conductors of different lengths. As an example, antenna operation in the cellular band (824 to 892 MHz) may be effected by using a helix conductor of pitch 45°, and length 6 inches. In addition, the type of polarization (i.e., linear or circular) of the radiation pattern projected by a helix antenna is dependent upon the ratio of the winding radius r to the radiation wavelength (e.g., 13.5 inches). In order to effect linear rather than circular polarization, the ratio r/ should be less than approximately 0.1.

Figure 2A:
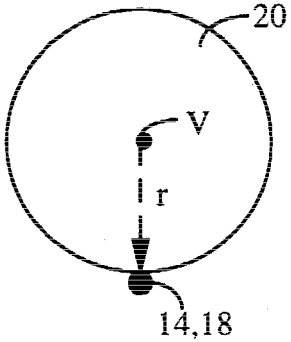
FIGS. 2A and 2B are overhead sectional views of an antenna of the invention having helix conductors of the same winding radius.
Figure 2B:
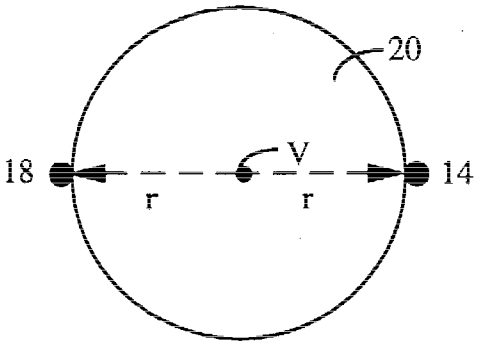

Another method of obtaining dual-band operation is to utilize helix conductors 14 and 18 of identical length, but to use harmonically-related frequencies to drive each conductor. For example, assume the operating frequency of a first antenna incorporating helix conductor 14 to be 100 MHz and the operating frequency of a second antenna incorporating helix conductor 18 to be 200 MHz. If both the first and second antennas were selected to be of an identical physical length equivalent to one-half of the operating wavelength of the second antenna, then in terms of electrical length the second antenna would become a "one-half wavelength" antenna and the first antenna would become a "one-quarter wavelength" antenna. That is, the first and second antennas would be of the same physical length but of different electrical lengths. Various other implementations may also be employed to achieve dual-band operation within the scope of the present invention. For example, again assuming operation at the above frequencies and again assuming the second antenna to be of a physical length equivalent to one-half of its operating wavelength, then dual-band operation may also be obtained by physically realizing the first antenna to be twice the length of the second antenna. Although in the embodiment of FIG. 1 the helix conductors 14 and 18 are of identical winding radii, in other embodiments it may be desired that the winding radii be different. In the latter case, the helix conductors 14 and 18 would be wound so as to be orthogonal in those horizontal planes within which the conductors would intersect were they of the same radii. This concept is illustratively represented by the overhead sectional views of the double helix antenna of the invention depicted in FIGS. 2A–2B and 3A–3B. Specifically, FIG. 2A is an overhead sectional view of the antenna 10 taken in horizontal plane $H_1$ (FIG. 1). In the horizontal plane $H_1$, conductors 14 and 18 orthogonally intersect (i.e., form right angles in the vertical dimension) on the surface of the winding member 20 of winding radius r. In FIG. 2B, conductors 14 and 18 are seen to be on opposite sides of vertical axis V when passing through the horizontal plane $H_2$.

Figure 3A:
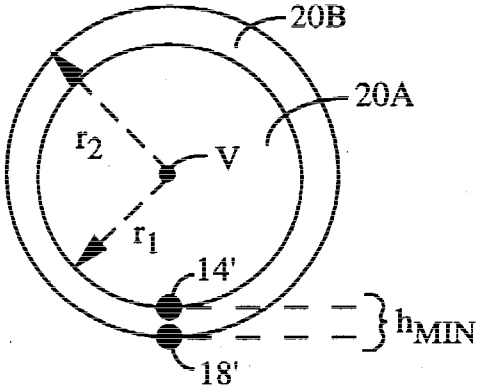
FIGS. 3A and 3B are overhead sectional views of an antenna of the invention having helix conductors of different winding radii.
Figure 3B:
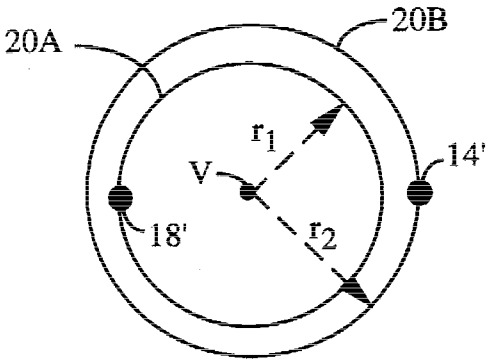

The overhead sectional views of FIGS. 3A and 3B are intended to depict the spatial relationship between orthogonally wound helix conductors 14' and 18' of different winding radii. In FIGS. 3A and 3B, a helix conductor 14' is wound upon an inner winding member **20*a* of winding radius $r_1$, and helix conductor 18' is wound about an outer winding member 20*b* of winding radius $r_2$. Since the conductors 14' and 18' are orthogonally wound in opposite directions in the above-described manner, the conductors 14' and 18' will be orthogonal in the vertical dimension when passing through horizontal plane $H_1$ (FIG. 3A). As is indicated by FIG. 3A, the separation between the conductors 14' and 18' is at a minimum ($h_{min}$) at the horizontal elevation of plane $H_1$. In contrast, the conductors 14' and 18' are maximally separated in the horizontal dimension when passing through plane $H_2$ (FIG. 3B). Accordingly, in the embodiment represented by FIGS. 3A and 3B the conductors 14' and 18' may be characterized as being orthogonal whenever separation in the horizontal dimension is equal to the minimum separation $h_{min}$. In FIG. 2A, the intersection of the conductors 14 and 18** results in a minimum horizontal separation ($h_{min}$) of zero.

Figure 4:
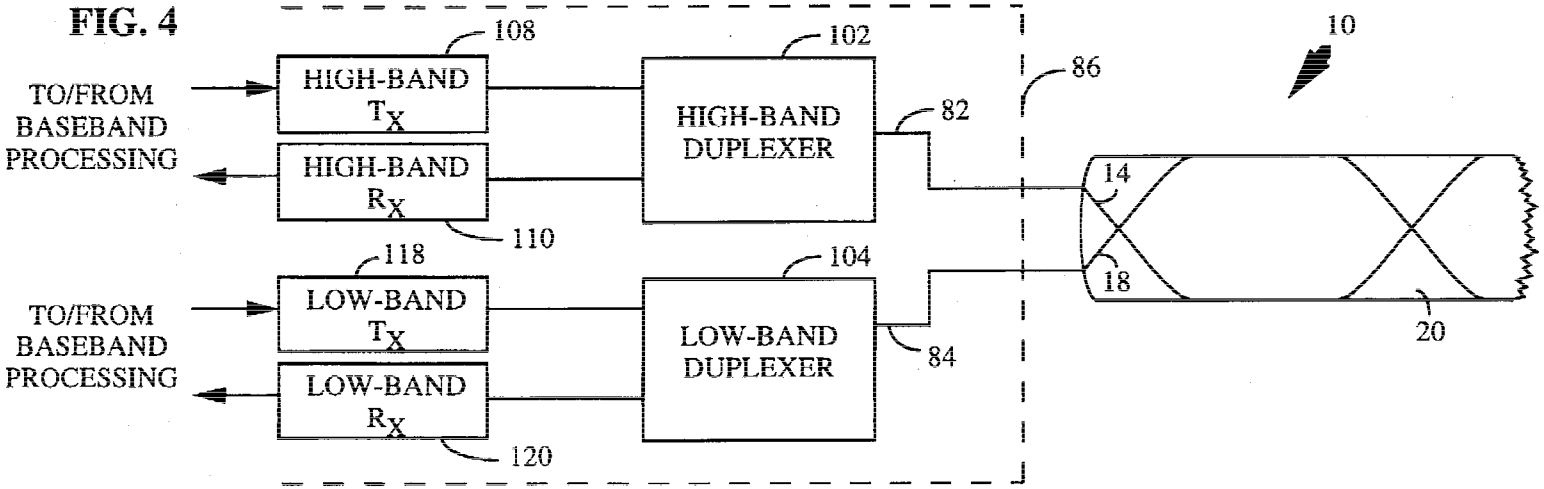
FIG. 4 is a block diagram is provided of the integration of the double helix antenna of the invention within a dual-band communications device.

Turning now to FIG. 4, a block diagram is provided of the integration of the double helix antenna of the invention within a dual-band communications device. As discussed above, the double helix antenna of the present invention may be implemented within a dual-band communications device (i.e., a dual-band portable phone) in a manner which reduces the filtering requirements imposed upon the antenna duplexer. In the implementation of FIG. 4, the first helix conductor 14 of antenna 10 is connected to the center conductor of high-band transmission feed line 82. Similarly, the second helix conductor is connected to the center conductor of low-band transmission feed line 84. The feed lines 82 and 84 may comprise, for example, stripline transmission lines having outer conductors electrically coupled to a shield 86 or other grounding surface of the dual-band communications device. A high-band duplexer 102 operates to bifurcate signal energy within a high band of frequencies into transmit and receive channels, which are utilized by a high-band transmitter 108 and a high-band receiver 110, respectively. Similarly, a low-band duplexer 104 segregates signal energy within a low band of frequencies between low-band transmit and receive channels, over which are respectively operative a low-band transmitter 118 and a low-band receiver 120.

In the embodiment of FIG. 4, the helix conductor 14 is selected to be of a length corresponding to an antenna bandwidth which encompasses the high band of frequencies passed by duplexer 102. Similarly, the length of helix conductor 18 is chosen to be of a length resulting in projection of an antenna pattern having a bandwidth centered about the passband of the low-band duplexer 104. Since minimal coupling exists between the helix conductors 14 and 18, the out-of-band attenuation required to be provided by duplexers 102 and 104 is minimized. This contrasts with a conventional implementations, in which duplexers 102 and 104 would typically both be coupled to a single whip antenna or the like. This would disadvantageously require the duplexers 102 to each exhibit a significantly greater degree of out-of-band attenuation.

Figure 5:
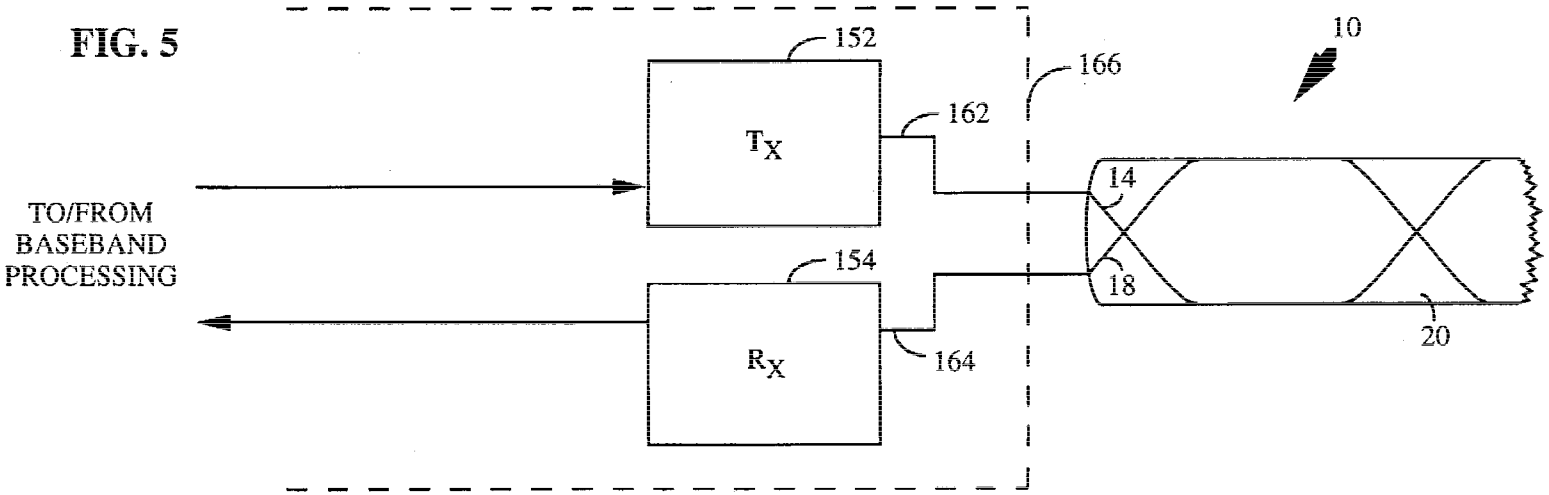
FIG. 5 shows a double helix antenna of the invention as employed within a single-band communications device.

The double helix antenna of the invention may afford similar advantages even when implemented within a single-band communications device, such as a portable telephone. Referring now to FIG. 5, the antenna 10 is shown to be employed within a single-band communications device having a transmitter 152 and a receiver 154. As an example, in existing cellular telephones the available cellular band is divided into transmit and receive spectra between 824 and 892 MHz. In this instance the lengths of the helix conductors 14 and 18 would be slightly different, thereby facilitating separate access to the transmit and receive portions of the cellular band.

In FIG. 5, the first helix conductor 14 of antenna 10 is connected to the center conductor of transmitter feed line 162, and the second helix conductor 18 is connected to the center conductor of receiver feed line 164. The feed lines 162 and 164 may comprise, for example, stripline transmission lines having outer conductors electrically coupled to a shield 166 or other grounding surface of the single-band communications device.

As is indicated by FIG. 5, a duplexer or other filter circuitry is not required to be interposed between the antenna 10 and the transmitter 152 or receiver 154. Again, the absence of significant coupling between helix conductors 14 and 18 obviates the need for additional isolation or filtering circuitry between the transmitter and receiver 152 and 154. This contrasts with the conventional case, in which a duplexer is connected between a single-element antenna and the device transmitter/receiver.

Referring to FIGS. 6A and 6B, perspective and top views are provided of an alternate embodiment of a double helix antenna configured to reduce operator exposure to electromagnetic field energy. The double helix antenna 200 includes a first helix conductor 214 and a second helix conductor 218. The first and second helix conductors 214 and 218 are seen to be wound in opposite directions about a cylindrical winding member 220, and are respectively driven by coaxial feed lines 226 and 228 in the manner described below. The center conductor 227 of the feed line 226 is electrically connected to the conductor 214, while the outer conductor of each feed line 226 and 228 is connected to electrical ground.

In the embodiment of FIGS. 6A and 6B, the winding member 220 comprises a conductive material having an inner surface 222 which defines a longitudinal cavity. An elongated conductor 224 is disposed within the longitudinal cavity, and may be separated from the inner surface 222 by a dielectric material (not shown). In this way the elongated conductor 224 and inner surface 222 form a coaxial transmission line, which is connected to feed line 228 proximate a bottom end 226 of winding member 220. Specifically, the elongated conductor 224 is connected to a center conductor 229 of the feed line 228. The elongated conductor 224 is also connected to the helix conductor 218 proximate an upper end 230 of the winding member 220, and thereby couples the helix conductor 218 to the antenna feed line 228.

As is indicated by FIG. 6A, the helix conductor 218 is wound from the upper end 230 of the winding member 220 over first (S1) and third (S3) segments thereof. Similarly, the helix conductor 214 is wound from the lower end 226 of winding member 220 over a second (S2) and the third (S3) segments. That is, the windings of helix conductors 214 and 218 overlap only within segment S3. In other embodiments the helix conductors 214 and 218 may not overlap whatsoever, and hence such overlap should not be construed as being a prerequisite to achieving successful operation of the antenna 200. It is also observed that the conductors 214 and 218 are wound orthogonally about the winding member 220, in that the conductors 214 and 218 are orthogonally directed at each point of mutual intersection within segment S3. In an exemplary implementation, the lower end 226 of the winding member 220 would be located proximate the housing of a portable phone (not shown), and hence the upper end 230 would be more distant therefrom.

It has been found that the electromagnetic field intensity produced by the helix conductors 214 and 218 is greatest at the feed line connection thereto. Since the feed line connection to the helix conductor 218 is effectively provided by the elongated conductor 224 proximate the upper end 230 of winding member 220, it follows that the electromagnetic field produced by helix conductor 218 is also at a maximum nearby the upper end 230. This results in substantially reduced operator exposure to electromagnetic energy, since in the exemplary implementation the upper end 230 of winding member 220 is displaced from the operator by the longitudinal length thereof. The antenna 200 thus desirably reduces operator exposure to electromagnetic energy, yet enables reception quality to remain independent of operator orientation by providing an omnidirectional field pattern.

The previous description of the preferred embodiments is provided to enable any person skilled in the art to make or use the present invention. The various modifications to these embodiments will be readily apparent to those skilled in the art, and the generic principles defined herein may be applied to other embodiments without the use of inventive faculty. Thus, the present invention is not intended to be limited to the embodiments shown herein but is to be accorded the widest scope consistent with the principles and novel features disclosed herein.

I claim:

1. A double helix antenna, comprising:

a first helix conductor wound in a first direction about a vertical axis of said double helix antenna; and a second helix conductor wound in a second direction about said vertical axis, said first and second helix conductors being wound so as to be orthogonal when minimum horizontal separation exists.

2. The antenna of claim 1 wherein said first helix conductor is of a first length and wherein said second helix conductor is of a second length different from said first length, said first and second lengths respectively corresponding to first and second frequency bands.

3. The antenna of claim 1 wherein said first helix conductor is of a first winding radius, and wherein said second helix conductor is of a second winding radius different from said first winding radius.

4. The antenna of claim 1 and further including a winding member about which are wound said first and second helix conductors.

5. The antenna of claim 1 and further including a transmission line feed structure having a center conductor connected to said first helix conductor and an outer conductor connected to an antenna ground plane.

6. A double helix antenna, comprising:

a first helix conductor of predetermined radius wound in a first direction about a longitudinal axis of said double helix antenna; and a second helix conductor of said predetermined radius wound in a second direction about said longitudinal axis, said first and second helix conductors being wound so as to be orthogonal at each point of mutual intersection.

7. The antenna of claim 6 and further including a winding member about which are wound said first and second helix conductors.

8. The antenna of claim 6 wherein said first helix conductor is of a first length and wherein said second helix conductor is of a second length different from said first length, said first and second lengths respectively corresponding to first and second frequency bands.

9. A double helix antenna system adapted for operation in a dual-band communications device, comprising:

a first helix conductor wound in a first direction about a longitudinal axis of said double helix antenna;

a first antenna feed network for connecting said first helix conductor to a first communications transceiver;

a second helix conductor wound in a second direction about said longitudinal axis, said first and second helix conductors being wound so as to be orthogonal when horizontal separation is at a minimum; and a second antenna feed network for connecting said second helix conductor to a second communications transceiver.

10. A double helix antenna system adapted for operation in a portable communications device, comprising:

a first helix conductor wound in a first direction about a longitudinal axis of said double antenna;

a first antenna feed network for connecting said first helix conductor to a transmitter of said communications device;

a second helix conductor wound in a second direction about said longitudinal axis, said first and second helix conductors being wound so as to be orthogonal when minimal horizontal separation exists; and a second antenna feed network for connecting said second helix conductor to a receiver of said communications device.

11. A double helix antenna, comprising:

a cylindrical winding member;

a first helix conductor wound in a first direction about said cylindrical winding member; and a second helix conductor wound in a second direction about said cylindrical winding member, said first and second helix conductors being wound so as to be orthogonal at points of mutual intersection.

12. The double helix antenna of claim 11 wherein said cylindrical winding member comprises a transmission line having an inner conductor and a cylindrical outer conductor.

13. The double helix antenna of claim 12 wherein said first helix conductor is wound from a first end of said winding member about said cylindrical outer conductor and is electrically connected to said inner conductor, and wherein said second helix conductor is wound from a second end of said winding member.

14. A double helix antenna, comprising:

a cylindrical winding member having a first end and a second end;

a first helix conductor wound from said first end in a first direction about a first segment of said cylindrical winding member; and a second helix conductor wound from said second end in a second direction about a second segment of said cylindrical winding member, said first and second helix conductors being orthogonal at points of mutual intersection.

15. The double helix antenna of claim 14 wherein said cylindrical winding member is constructed of conductive material.

16. A double helix antenna, comprising:

a cylindrical conductor having a first end, a second end, an outer surface, and an inner surface defining a cylindrical cavity in which is disposed an elongated conductor extending between said first and second ends;

a first helix conductor wound from said first end in a first direction about a first segment of said outer surface, said first helix conductor being electrically connected to said elongated conductor at said first end of said cylindrical conductor; and a second helix conductor wound from said second end in a second direction about a second segment of said outer surface, said first and second helix conductors being orthogonal at points of mutual intersection.

17. A double helix antenna, comprising:

a first helix conductor wound in a first direction about a vertical axis of said double helix antenna; and a second helix conductor wound in a second direction about said vertical axis, said first and second helix conductors being wound so as to be orthogonal when the radial separation between said first and second helix conductors is 0 degrees of arc.

* * * * *